United States Patent [19]

Harbison

[11] 3,983,886

[45] Oct. 5, 1976

[54] FRAME AND HOOD FOR A WIG FORM

[76] Inventor: Deloris J. Harbison, 2500 Independence Ave., Kansas City, Mo. 64124

[22] Filed: Oct. 15, 1975

[21] Appl. No.: 622,459

[52] U.S. Cl. ..... 132/9

[51] Int. Cl.[2] ..... A45D 1/00

[58] Field of Search ..... 132/9, 39, 46, 49, 53–54; 2/68, 171, 174, 201, 208; 128/171, 164, 76; 223/66

[56] References Cited

UNITED STATES PATENTS

| | | | |
|---|---|---|---|
| 593,560 | 11/1897 | Barrett | 132/54 |
| 3,444,865 | 5/1969 | De Vita | 132/53 |
| 3,447,726 | 6/1969 | George | 223/66 |

*Primary Examiner*—G.E. McNeill

*Attorney, Agent, or Firm*—John N. Randolph

[57] ABSTRACT

A frame which is detachably secured to a wig form supports a fabric hood or cover of a lightweight flexible material over a wig, which is applied to the form, to protect the wig from dust. The hood or cover is supported by the frame so as not to mash or otherwise disturb the wig while positioned thereover. A handle which forms a part of the frame and extends over the top of the form, above the cover, is utilized for lifting the form with the wig applied thereto.

8 Claims, 6 Drawing Figures

FRAME AND HOOD FOR A WIG FORM

Summary

It is a primary object of the present invention to provide a novel cover of a lightweight fabric material and a supporting frame on which the cover is detachably mounted to be positioned over a wig mounted on a form to which the frame is attached.

Another object of the invention is to provide a hood or cover supporting frame which, when detachably connected to a wig form, will support the hood or cover substantially out of contact with a wig applied to the form, so as to protect the wig from dust without applying any pressure to the wig.

Another object of the invention is to provide a wig hood supporting frame by means of which a wig form may be readily lifted when the frame is applied thereto.

Still a further object of the invention is to provide a wig hood supporting frame having a detachable part for retaining the hood applied to the frame, and which further functions to support a part of the hood away from and out of contact with the wig.

Various other objects and advantages of the invention will hereinafter become more fully apparent from the following description of the drawings, illustrating a presently preferred embodiment thereof, and wherein:

DESCRIPTION OF THE PREFERRED EMBODIMENT

Figure 1:
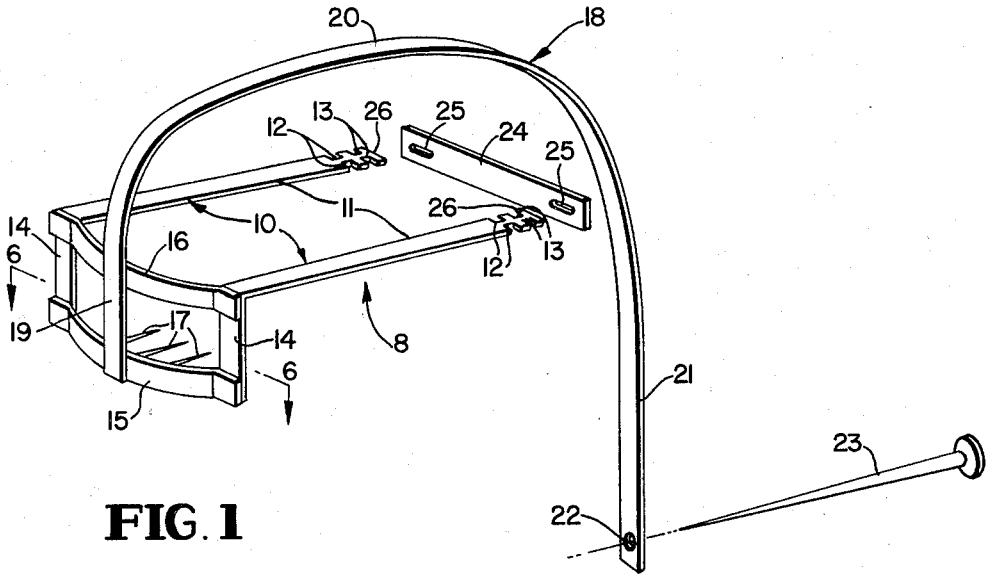
FIG. 1 is a perspective view of the hood supporting frame with certain of the parts detached.
Figure 2:
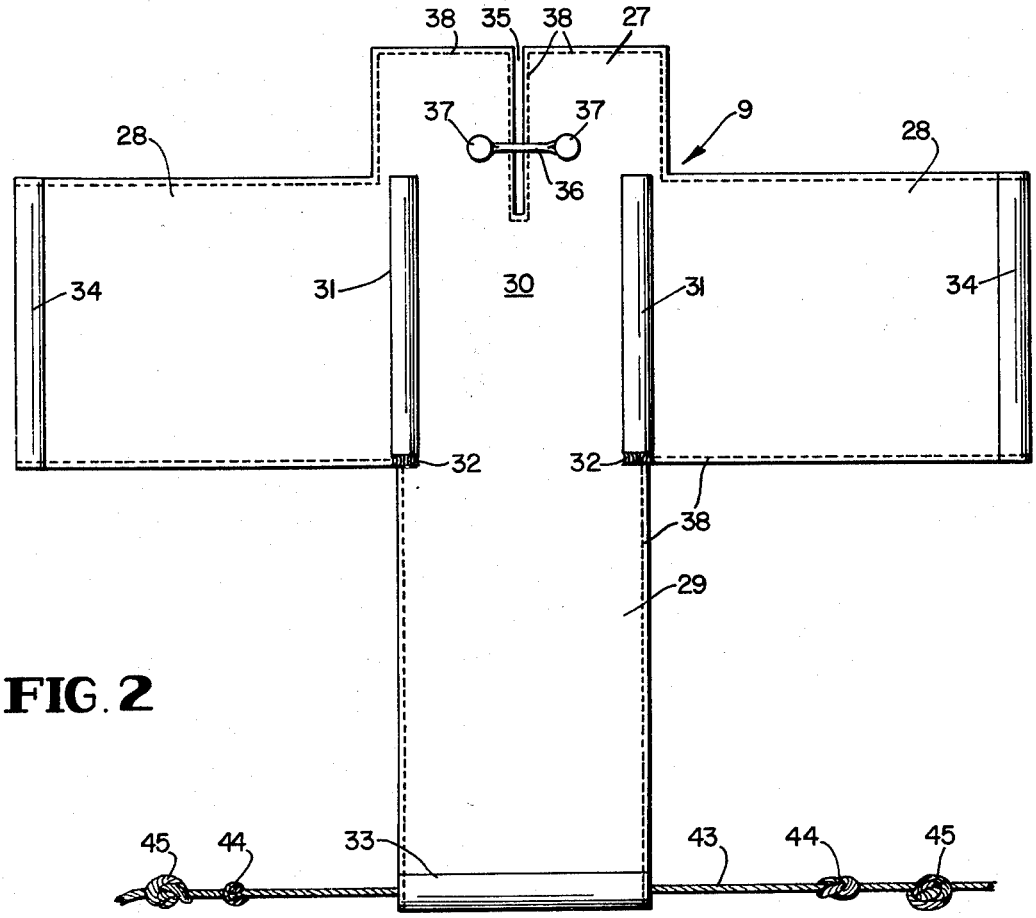
FIG. 2 is a bottom plan view of the hood or cover.

Referring more specifically to the drawings, the wig frame and hood in its entirety and comprising the invention is designated generally 7 and includes a frame, as seen in FIG. 1, designated generally 8, and a hood or cover, as best seen in FIG. 2, and designated generally 9.

The frame 8 includes two bars 10 having elongate straight end portions 11 which are disposed substantially coplanar and which have terminals each provided with a pair of notches 12 and a pair of notches 13. The notches 12 and 13 open outwardly of the side edges of the bar portions 11. The bars 10, remote from their notched terminals, are bent downwardly at approximately right angles to provide opposite end portions 14. Two cross bars 15 and 16 extend between the bar portions 14 and have terminals which are secured, in any conventional manner, to the bar portions 14 adjacent upper and lower ends thereof, so that the upper bar 16 is disposed substantially above and spaced from the lower bar 15. The bars 15 and 16 are bowed outwardly relative to the bar portions 14 between the terminals thereof. The lower bar 15 has a plurality, preferably three, long slender tapered pins 17 which project from the inner concave side thereof, between and spaced from bar portions 14 and in laterally spaced relation to one another.

An elongated curved bar 18 has a shorter turned down end 19 the terminal part of which extends across the outer convex sides of the intermediate portions of the bars 15 and 16 and which is secured thereto in any conventional manner. An intermediate portion 20 of the bar 18 extends rearwardly from the bars 15 and 16 and is disposed above the level of the bar portions 11 and midway therebetween. The bar 18 has a longer opposite end 21 which is provided adjacent its terminal with an opening 22, for receiving a long tapered pin 23 for a purpose which will hereinafter be described.

A bar 24 has elongated slots 25 adjacent the ends thereof and which extend longitudinally of said bar to engage detachably with the notches 13 for attaching the bar 24 to the bars 10. The bar portions 11 at their distal ends, beyond the notches 13, are laterally elongated slightly on their inner edges to provide heads 26, each of which is of a length only slightly less than the length of each of the slots 25.

The cover 9, as best seen in FIG. 2, is formed of a lightweight flexible fabric material, such as cotton or nylon, which is substantially cross shaped, to provide a short front portion 27, corresponding side portions 28, a rear portion 29, which is longer than the side portions 28 but somewhat narrower than the front portion 27, and a top portion 30 which is disposed between the side portions 28. Parallel tubular portions 31 of the same material as the remainder of the cover 9 are secured to its underside along the side edges of the top portion 30. The rear ends of the tubular portions 31 are elasticized and gathered, as seen at 32, for a purpose which will hereinafter be described. The outer end of the back portion 29 is rolled or hemmed to provide a sleeve 33 which extends transversely thereacross and has open ends. The outer ends of the side portions 28 may be provided with similar tubes or sleeves 34. The front portion 27 has a slot 35 midway of its edges which extends inwardly from its forward or outer edge to the innermost part of said front portion. An elastic strap 36 extends across the slot 35, near its inner end, and is detachably connected to pins or fastenings 37 which are mounted on the inner side of the front piece 27. The remaining edges of the cover 9 and the margin of the slot 25 are preferably hemmed as indicated by the broken lines 38.

Figure 5:
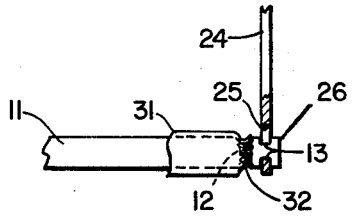
FIG. 5 is an enlarged fragmentary plan view, partly in horizontal section, of a part of the frame, taken substantially along a plane as indicated by the line 5—5 of FIG. 4.

FIG. 2 illustrates the underside of the cover 9. Said cover 9 is initially turned over from its position of FIG. 2. With the bar 24 detached from the bar portions 11, the forward ends of the tubes 31 are applied to the bar portions 11 over their ends 26 and advanced forwardly until the forward ends of the tubes 31 contact the downturned bar portions 14. The rear, elasticized ends 32 of the tubes 31 are then pulled forwardly over the heads 26 and past the notches 13, so as to engage in the notches 12, which hold the tubes 31 from sliding forwardly on the bar portions 11. The bar portions 11 are then sprung slightly toward one another so that the heads 26 can be passed through the slots 25 of the bar 24, after which the bar portions 11 are released to spring apart, so that the outer ends of the slots 25 will engage the outwardly opening notches 13, to detachably retain the bar 24 applied to the bar portions 11, as illustrated in FIG. 5.

The rear head portion 29 is disposed over the bar 24. The front portion 27 extends downwardly over the outer convex sides of the bars 15 and 16 with the inner end of the slot 25 disposed above the upper bar 16. The elastic strap 36 is disconnected from one of the fastenings 37 and passed across the inner side of the bar portion 19, below the bar 16, and then again connected to said fastening 37, for retaining the front portion 27 positioned as heretofore described and illustrated in FIGS. 3 and 4.

Figure 3:
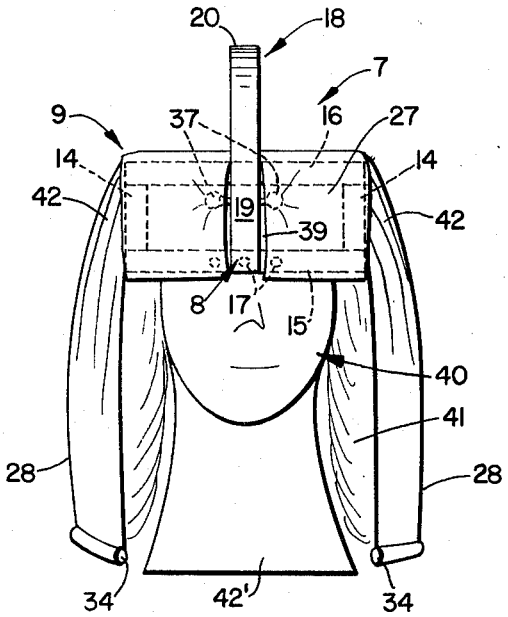
FIG. 3 is a front elevational view showing the frame and hood applied to the wig form and with the hood disposed over a wig supported by the form.
Figure 4:
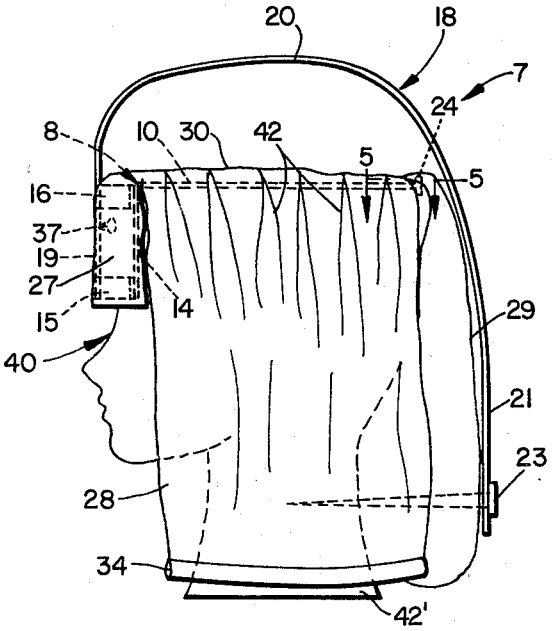
FIG. 4 is a side elevational view of the parts seen in FIG. 3.
Figure 6:
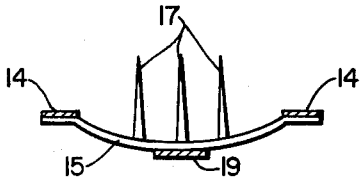
FIG. 6 is a horizontal sectional view taken substantially along a plane as indicated by the line 6—6 of FIG. 1.

The pins 17 are then forced into the forehead portion 39 of a wig form 40 to which a wig 41 is applied. The tubes 31, supported by the bar portions 11, support the top portion 30 of the hood 9 above and out of contact with the top portion of the wig 41. As seen in FIGS. 3 and 4, the top portion 30 and tubes 31 are longer than the top portion of the wig and the bar portions 11, so that said portion 30, the sleeves 31 and the inner or upper portions of the sides 28 are gathered, as indicated at 42. The side portions 28 extend down over the sides of the wig 41 to below its bottom edge. The back portion 29 hangs down from the bar 24 on the outer side of the back portion of the wig and to below its bottom edge, so that the wig 41 is completely covered by the hood 9 and thus protected from dust. The hood 9 is supported solely by the frame 8 so that it does not rest upon and adversely affect the shape of the wig.

The pin 23 is passed inwardly through the opening 22 and is driven into the neck portion 42' of the form 40 for anchoring the bar portion 21 detachably to the wig form 40 to rigidify the portion 20 which forms a handle by means of which the wig form 40 may be lifted and carried with the parts as shown in FIGS. 3 and 4 applied thereto.

A cord 43 may be passed through the tube or sleeve 31. The cord 43 may have knots 44 and 45 adjacent each end thereof. The ends of the cord 43 may be drawn inwardly around the neck 42 and attached in any suitable manner as by pins which engage through the knots 44 and/or 45, for pulling the bottom part of the back panel 29 up and under the bottom of the rear part of the wig 41. Similar cords 43, not shown, may be applied to the sleeves 34 for use in the same manner and for the same purpose.

Parts 18 and 43 may be omitted and various other modifications and changes are contemplated and may be resorted to, without departing from the function or scope of the invention.

I claim as my invention:

1. A frame and hood for a wig form, said frame having a front portion for engagement with the forehead portion of a wig form, means anchoring said front portion of the frame to the wig form, said frame having a top portion extending rearwardly from said front portion over the top of the wig form and over a wig supported thereon; said hood having a top portion resting on the top portion of said frame and by which the hood is supported, and said hood including side portions and a rear portion depending from said top portion and covering the back and sides of the wig.

2. A frame and hood for a wig form as in claim 1, a bar having a depending end secured to an outer side of said front portion, said bar including an upper portion extending rearwardly from said bar end and disposed above said top portion of the frame and forming a carrying handle.

3. A frame and hood for a wig form as in claim 2, said bar having a depending opposite end extending downwardly from a rear end of the handle, and means for detachably anchoring said last mentioned bar end to a rear portion of the wig form.

4. A frame and hood for a wig form, as in claim 1, said frame top portion comprising transversely spaced bars, and said top portion of the hood having transversely spaced sleeves secured thereto and detachably engaging said bars.

5. A frame and hood for a wig form as in claim 4, and means for releasably retaining said sleeves applied to said bars.

6. A frame and hood for a wig form as in claim 2, said hood including a front portion depending from said top portion and disposed over the front portion of the frame, and means carried by said front portion of the hood and detachably engaging said bar end for connecting the hood to the front portion of the frame.

7. A frame and hood for a wig form as in claim 4, and means detachably connected to the rear ends of said bars and cooperating with the front portion of the frame for detachably retaining the sleeves in engagement with said bars.

8. A frame and hood for a wig form as in claim 1, said rear portion and side portions of the hood having sleeves at their lower ends, and means engaging through said sleeves and engageable with said form for holding the rear portion and side portions of the hood under bottom portions of the wig.

* * * * *